US007285925B2

(12) United States Patent
Chen et al.

(10) Patent No.: US 7,285,925 B2
(45) Date of Patent: Oct. 23, 2007

(54) BACKLIGHT MODULE CONTROL CIRCUIT OF MULTI-LAMP DISPLAY DEVICE

(75) Inventors: Sy-Shang Chen, Hsin Tien (TW); Alex Leng, Hsin Tien (TW); Allen Lee, Hsin Tien (TW); Hsien-Min Yeh Liang, Hsin Tien (TW)

(73) Assignee: Chuntex Electronic Co., Ltd., Taipei Hsien (TW)

( * ) Notice: Subject to any disclaimer, the term of this patent is extended or adjusted under 35 U.S.C. 154(b) by 107 days.

(21) Appl. No.: 11/326,655

(22) Filed: Jan. 6, 2006

(65) Prior Publication Data

US 2007/0159117 A1 Jul. 12, 2007

(51) Int. Cl.
*H05B 37/00* (2006.01)

(52) U.S. Cl. ..... 315/312; 315/291; 315/307; 315/300; 315/308

(58) Field of Classification Search ..... 315/312, 315/291, 307, 308
See application file for complete search history.

(56) References Cited

U.S. PATENT DOCUMENTS 6,552,501 B2 * 4/2003 Ito et al. ..... 315/308
7,002,306 B2 * 2/2006 Cull et al. ..... 315/291
2005/0225261 A1 * 10/2005 Jin ..... 315/255
2007/0018593 A1 * 1/2007 Kuo ..... 315/312
2007/0085488 A1 * 4/2007 Ribarich et al. ..... 315/224

* cited by examiner

*Primary Examiner*—Trinh Vo Dinh
(74) *Attorney, Agent, or Firm*—William E. Pelton, Esq.; Cooper & Dunham LLP

(57) ABSTRACT

A backlight module control circuit of a multi-lamp display device includes a control unit, multiple lamp driving circuits and a fault detection unit. The control unit includes multiple signal output terminals. Input terminals of the lamp driving circuits are respectively coupled to a signal output terminal of the control unit and output terminals of the lamp driving circuits are respectively coupled to a terminal of a lamp. A fault detection unit includes multiple signal detection input terminals, which are respectively coupled to multiple lamp driving circuits and lamps. The fault detection unit can detect whether any one of the lamps is out of order and then output a signal to the control unit, so as to make the control unit shut down the driving circuit of the failure lamp and continue to maintain an operation of other normal lamps.

14 Claims, 9 Drawing Sheets

20a
CN701
M24264P
OP1
OP2
R705 680
R707 22K
R709 680
R712 680
R713 22K
R715 680
D703
BAV99
D704 10PF/3KV
D702
D709 10PF/3KV
D705
C707
0.015UF
C706 NC
C712
C711 NC
T701
TRNSFMR 67114750
C705 10UF
C751 470u/25V
C702 470u/25V
NDT456P/SO Q702
Q707 NDT455N/SOT
Q720 MJE210
R750 10k
R751 10k
Q721 MJE210

BACKLIGHT MODULE CONTROL CIRCUIT OF MULTI-LAMP DISPLAY DEVICE

BACKGROUND OF THE INVENTION

1. Field of the Invention

The invention relates in general to a backlight module control circuit, and more particularly to a backlight module control circuit for a multi-lamp display device.

2. Description of the Related Art

A flat display panel such as a plasma display panel or a liquid crystal display (LCD) becomes more and more popular nowadays. Although with the advances of processing technique, the size of the flat display panel is enlarged to satisfy the consumers. In terms of operation principle, a basic operation principle of the plasma display panel makes use of voltage to control gas molecules, so as to activate fluorescent material to produce chemical reaction to present various colors. Moreover, the light source of the LCD is provided by a backlight module configured inside the display. The backlight module includes a light emitting device, which is commonly made up by lamps. The number of the lamps varies in accordance with the size of the display device.

For wide screen display device, the number of the lamps can be up to eight, twelve or more lamps. A conventional method uses a control circuit to control on/off operations and brightness of the lamps. However, a main drawback of the conventional control circuit is that when any one of the lamp is out of order, all of the other lamps are closed, so as to stop the display device.

SUMMARY OF THE INVENTION

In view of the drawback of the conventional control circuit, the present invention provides a backlight module control circuit of a multi-lamp display device including a control unit, a plurality of lamp driving circuits and a fault detection unit. The control unit includes a plurality of signal output terminals. The control unit can be made up by a microprocessor or a control circuit having a plurality of active or passive electronic components. An input terminal of each of the lamp driving circuits is coupled to a signal output terminal of the control unit and an output terminal of each of the lamp driving circuits is coupled to a terminal of a lamp. A fault detection unit includes a plurality of signal detection input terminals. The signal detection input terminals are respectively coupled to the lamp driving circuits and a plurality of lamps. The fault detection unit further includes a control signal output terminal coupled to the control unit.

The fault detection unit can detect whether any one of the lamps is out of order and then output a signal to the control unit, so as to make the control unit shut down the driving circuit of the failure lamp and continue to maintain an operation of other normal lamps. In this way, high voltage of the driving circuits can avoid damaging the display device by shutting down the high voltage of the driving circuit of the failure lamp. Moreover, the whole brightness of the display device still can keep normal without decreasing the display quality of the images by the control unit to enhance the driving electric circuit of the other normal lamps.

DETAILED DESCRIPTION OF THE INVENTION

Figure 1:
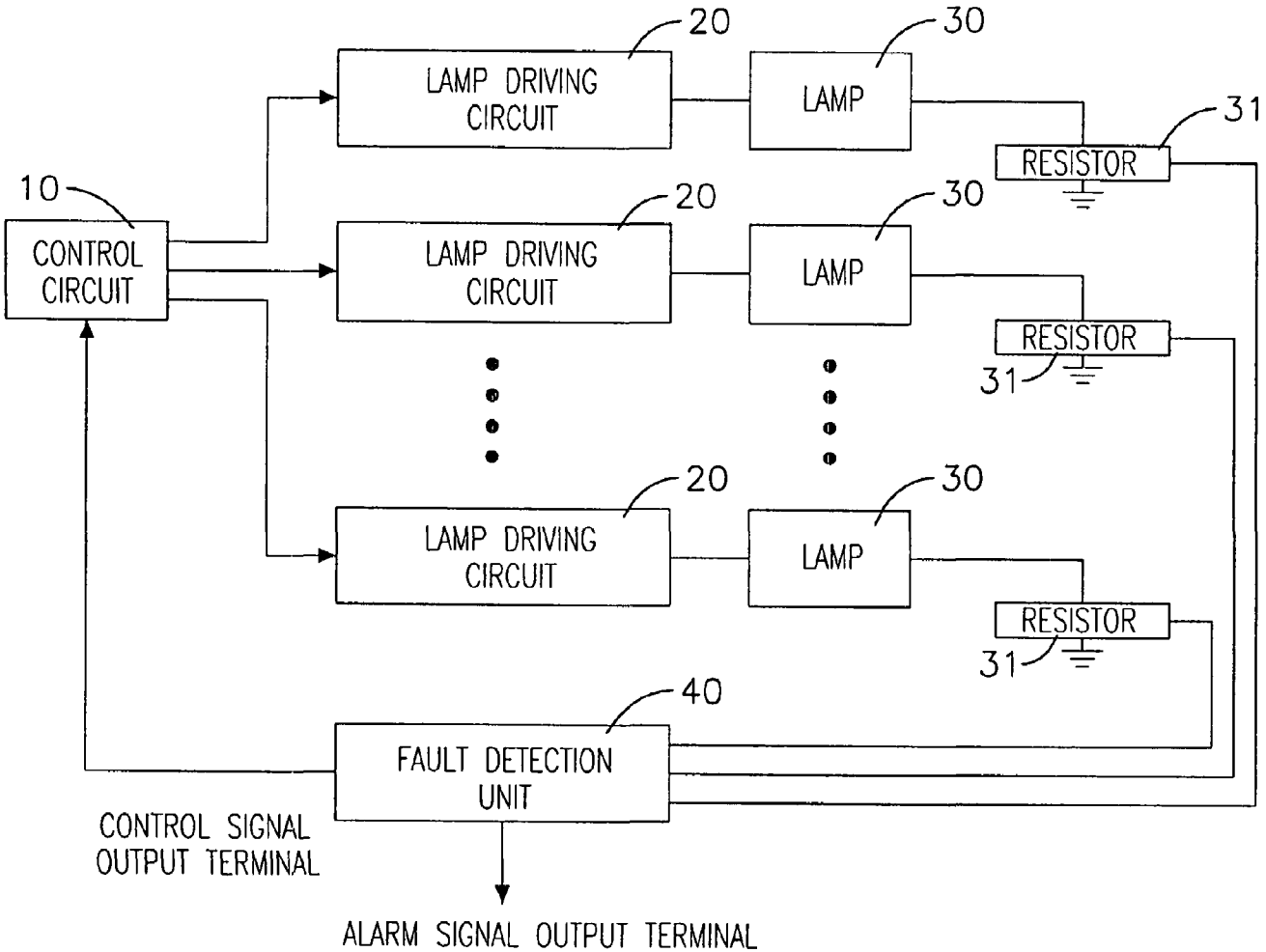
FIG. 1 is a block diagram of a first embodiment of a backlight module control circuit of a multi-lamp display device of the present invention.

With reference to FIG. 1, a first embodiment of a backlight module control circuit of a multi-lamp display device of the present invention includes a control unit 10, multiple lamp driving circuits 20 and a fault detection unit 40. The control unit 10 includes multiple signal output terminals. The control unit 10 can be made up by a microprocessor or a control circuit having active or passive electronic components.

Further, an input terminal of each lamp driving circuits 20 is coupled to a signal output terminal of the control unit 10. An output terminal of each lamp driving circuits 20 is coupled to a terminal of a lamp 30. The other terminal of the lamp 30 is coupled to the ground through a resistor 31. Each lamp driving circuits 20 includes an individual PWM controller to control on/off cycles of the corresponding lamps 30.

The fault detection unit 40 has multiple signal detection input terminals. The signal detection input terminals are respectively coupled to the lamp driving circuits 20 and the corresponding resistors 31. The fault detection unit 40 further includes an alarm signal output terminal and a control signal output terminal which is feedback-connected to the control unit 10.

When any one of the lamps 30 is out of order, an electric current can not go through the failure lamp 30 due to a broken circuit. At this moment, the fault detection unit 40 can detect the failure lamp 30 and then output an alarm signal to the control unit 10, so as to make the control unit 10 shut down the driving circuit 20 of the failure lamp 30.

On the other hand, for a multi-lamp display device, other normal lamps 30 still continue to operate even though one of the lamps 30 is out of order. Moreover, the control unit 10 also can enhance a driving current to output to the other normal lamps, so as to increase brightness of every operating lamp 30. Hence in terms of a user's perspective, the display device still keeps in a good operation status.

Furthermore, the fault detection unit 40 also outputs a signal through the alarm signal output terminal to inform the user of the failure lamp 30, so as to remind the user to repair the failure lamp 30.

Figure 2:
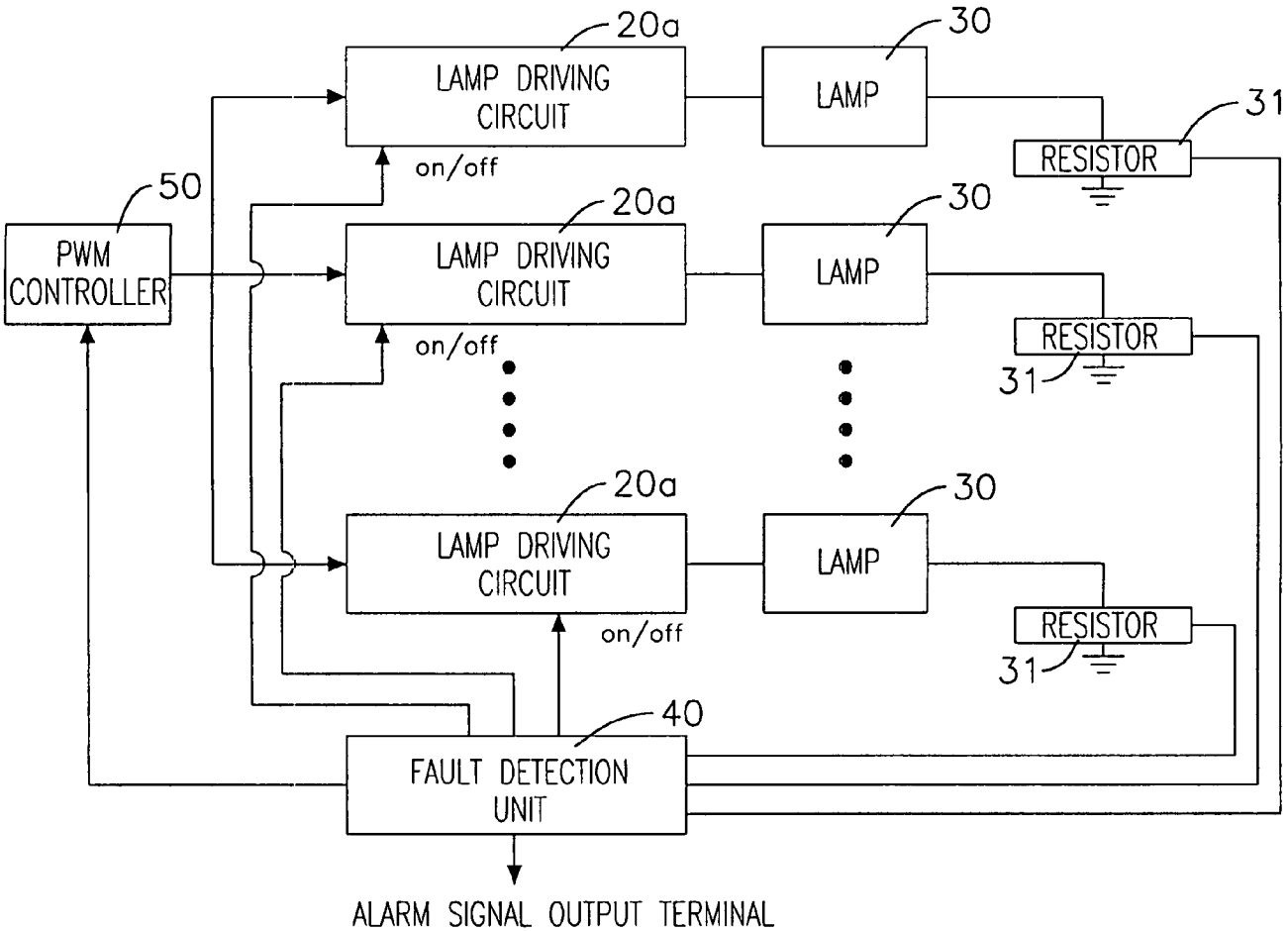
FIG. 2 is a block diagram of a second embodiment of a backlight module control circuit of a multi-lamp display device of the present invention.

With reference to FIG. 2, a second embodiment of a backlight module control circuit of a multi-lamp display device of the present invention includes a PWM controller 50, multiple lamp driving circuits 20*a* and a fault detection unit 40. The PWM controller 50 includes a signal output terminal. An input terminal of each lamp driving circuits 20*a* is coupled to the signal output terminal of the PWM controller 50. An output terminal of each lamp driving circuits 20*a* is coupled to a terminal of a lamp 30. The other terminal of the lamp 30 is coupled to the ground through a resistor 31.

The fault detection unit 40 includes multiple signal detection input terminals. The signal detection input terminals are respectively feedback-connected to the corresponding resistors 31 to detect whether any abnormal lamp 30 exists. The fault detection unit 40 further includes an alarm signal output terminal and a plurality of control signal output terminals. The control signal output terminals are feedback-connected to the PWM controller 50 and the lamp driving circuits 20*a*.

When any one of the lamps 30 is out of order, an electric current can not go through the failure lamp 30 due to a broken circuit. At this moment, the fault detection unit 40 can detect the failure-lamp 30 and then output a signal via the control signal output terminal, so as to shut down the driving circuit 20 of the failure lamp 30. At the same time, the fault detection unit 40 outputs a feedback signal to the PWM controller 50, so as to make the PWM controller 50 acquire the normal/abnormal status of the lamps 30. The PWM controller 50 accordingly enhances a working period of the output signal within a permitted range after shutting down the driving circuit 20 of the failure lamp 30, so as to enhance an operation current that flows through other normal lamps 30 to reinforce a loss of the brightness of the failure lamp 30.

The PWM controller 50 asamples a part of the electric current from each lamp 30 to determine whether all the lamps 30 are normal. For example, the PWM controller 50 collects 1 mA form each of the lamps. Assume that there are sixteen lamps; the PWM controllers 50 can collect 16 mA electric current in total. By using a current to voltage converter circuit, suppose 1.6V voltage can be gained. However, when any of the lamps 30 is abnormal, the total feedback electric current will be less than 16 mA and the converted voltage will be less than 1.6V. The voltage value can be a reference for the PWM controller 50 to determine whether the working period should be adjusted. If the voltage value is less than 1.6V, the PWM controller 50 enhances the working period, so as to enhance an operation current that flows through other normal lamps 30.

Figure 3:
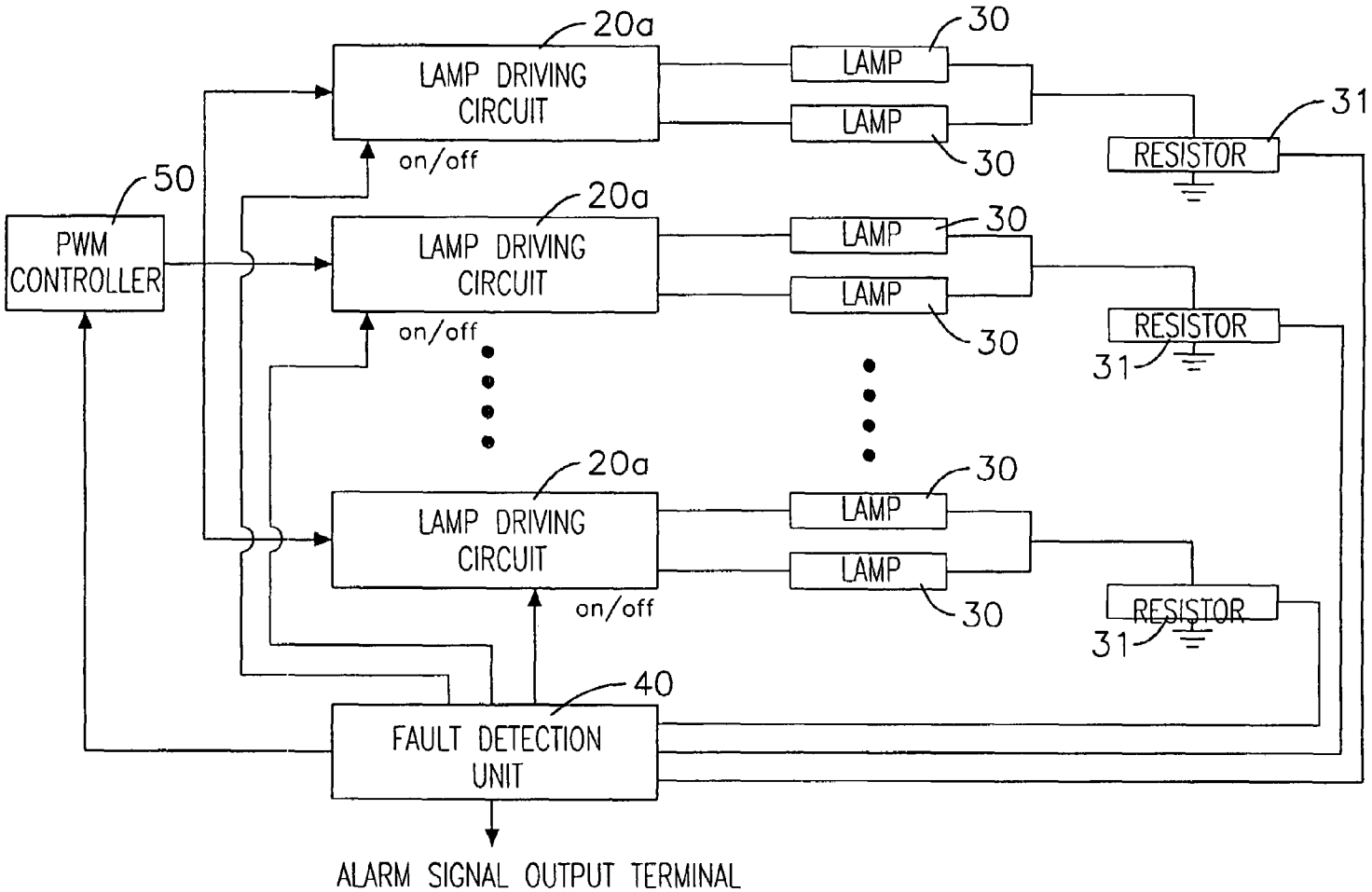
FIG. 3 is a block diagram of a third embodiment of a backlight module control circuit of a multi-lamp display device of the present invention.
Figure 4A:
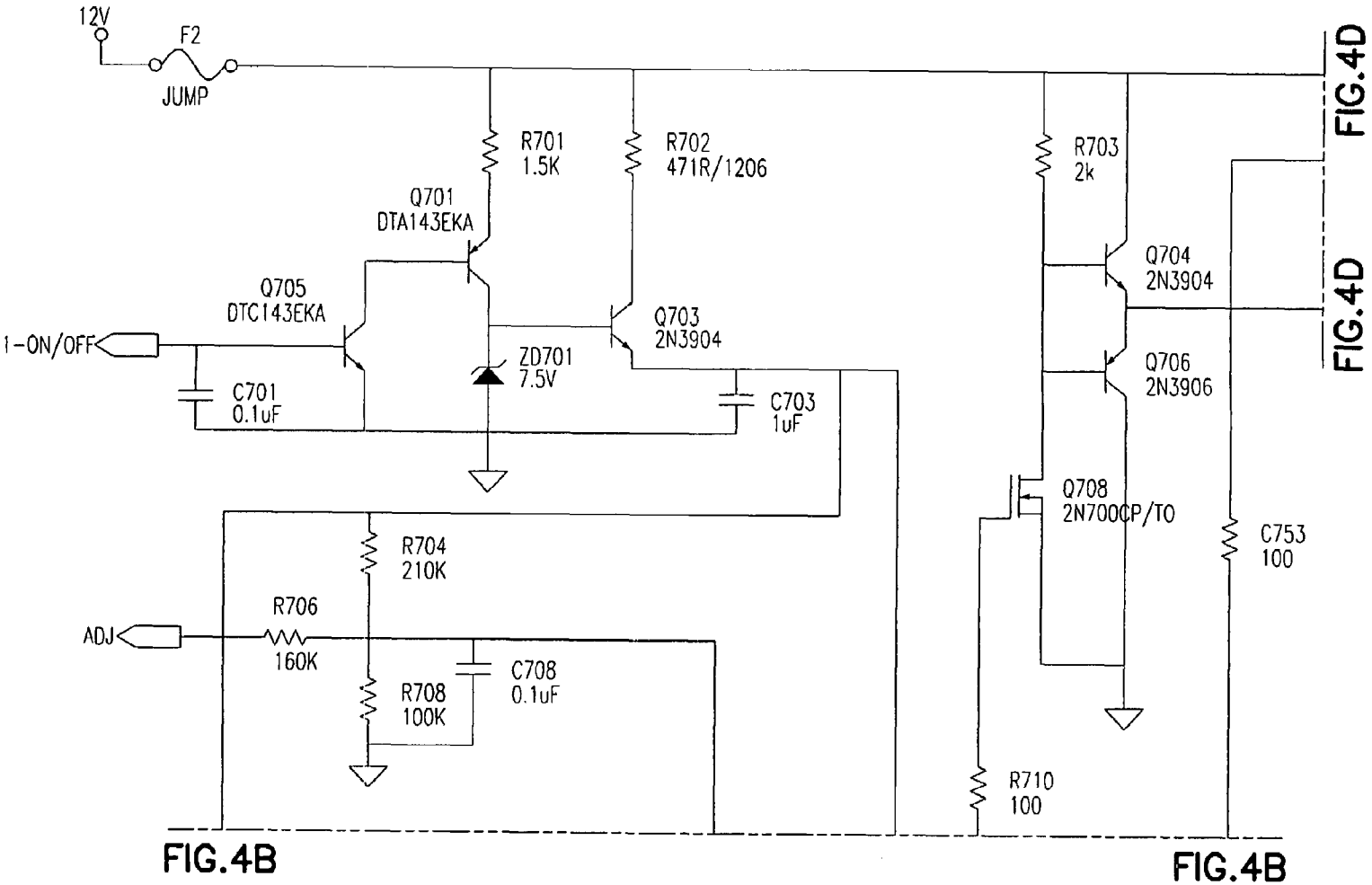
FIG. 4 shows a detailed circuit diagram of the backlight module control circuit of a multi-lamp display device of the present invention.
Figure 4B:
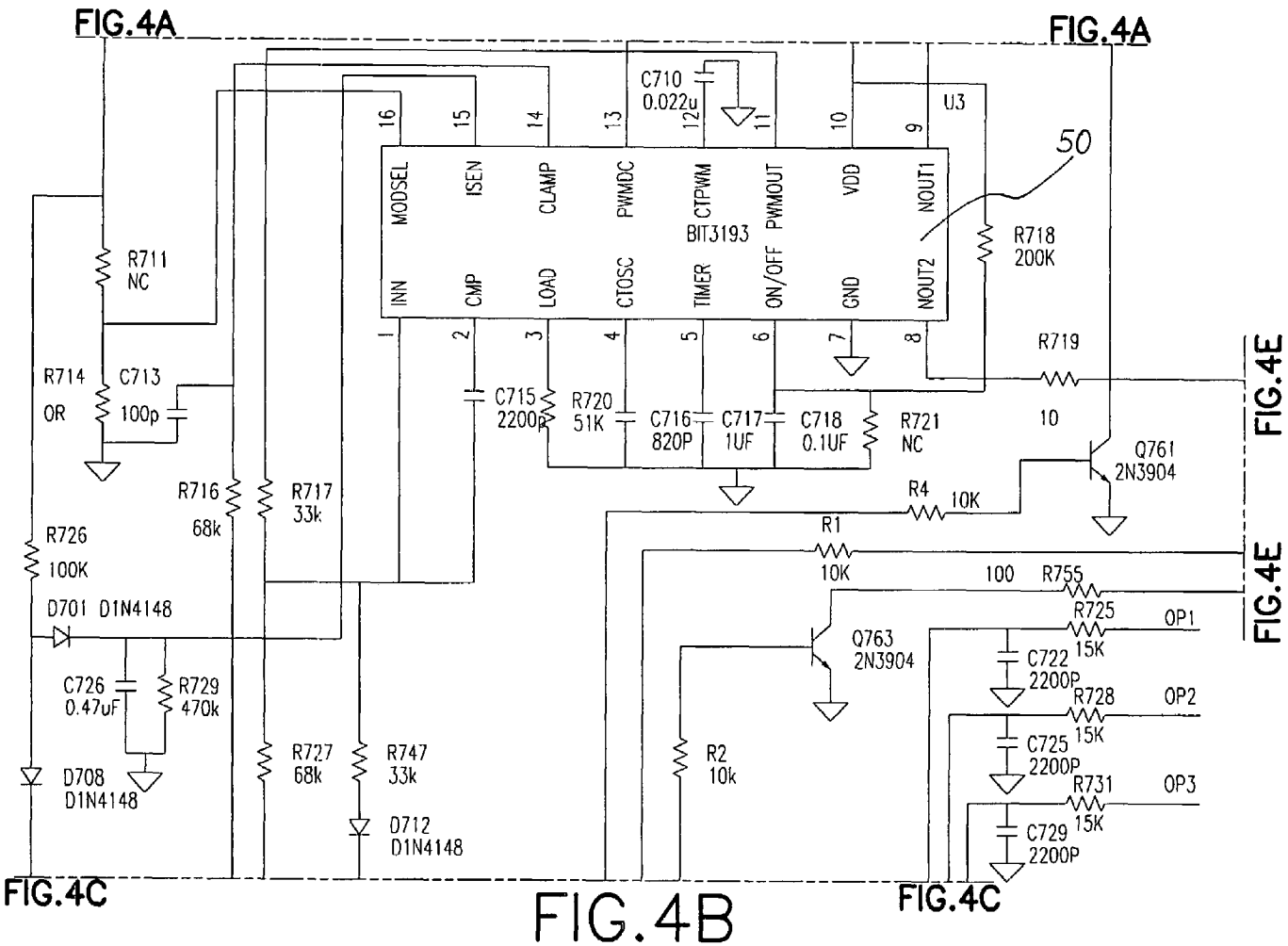
Figure 4C:
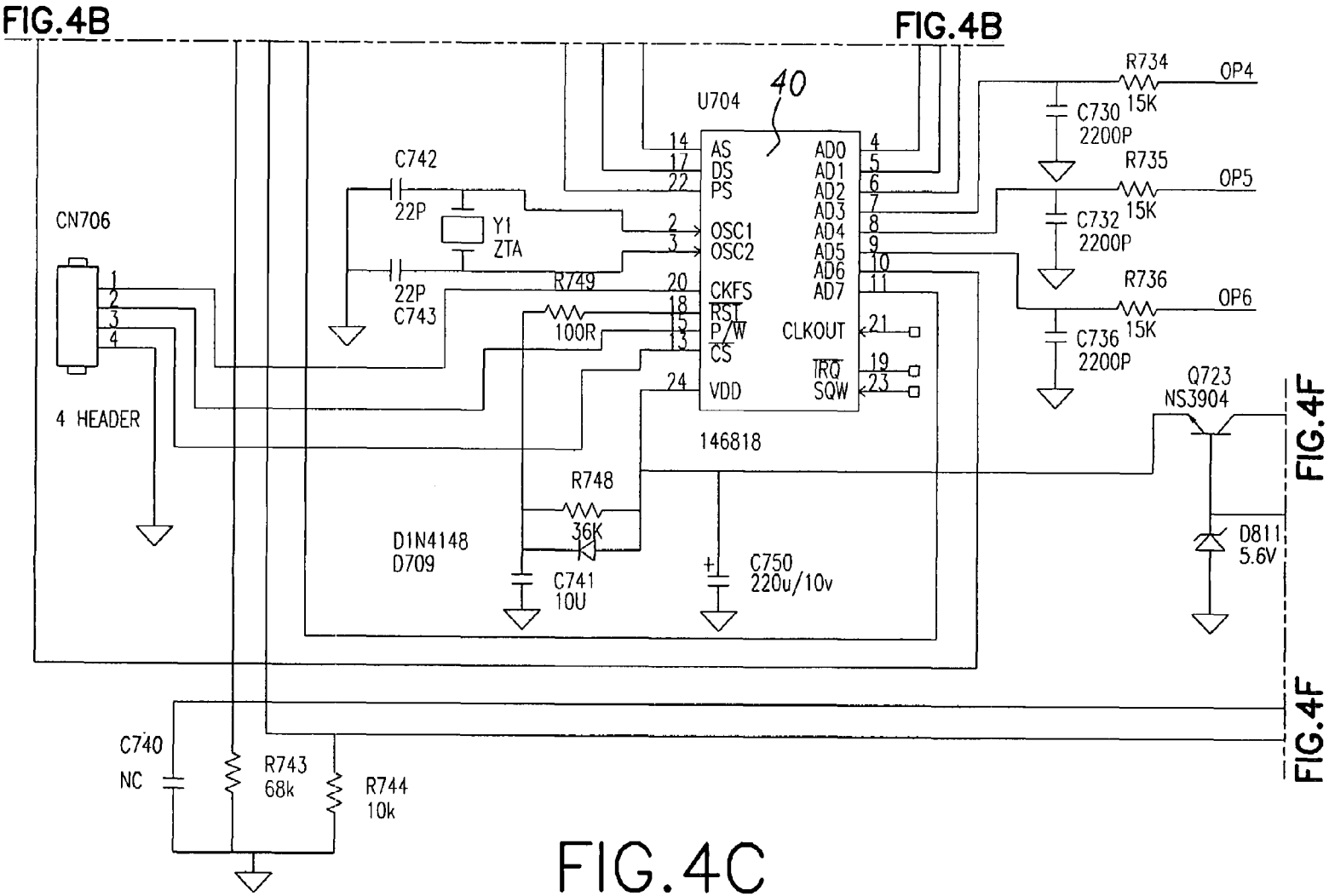
Figures 4A, 4D, 4E:
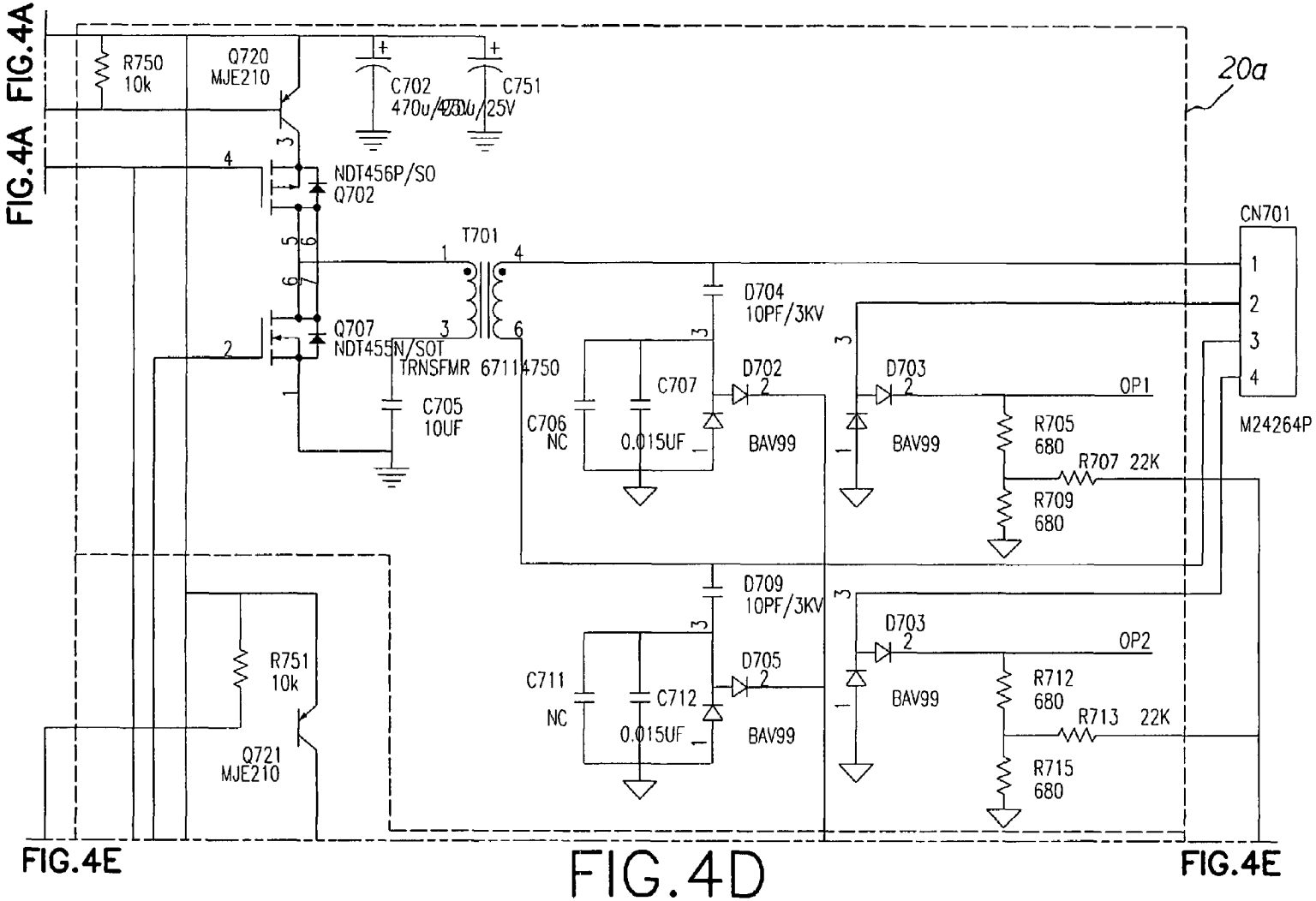
Figure 4E:
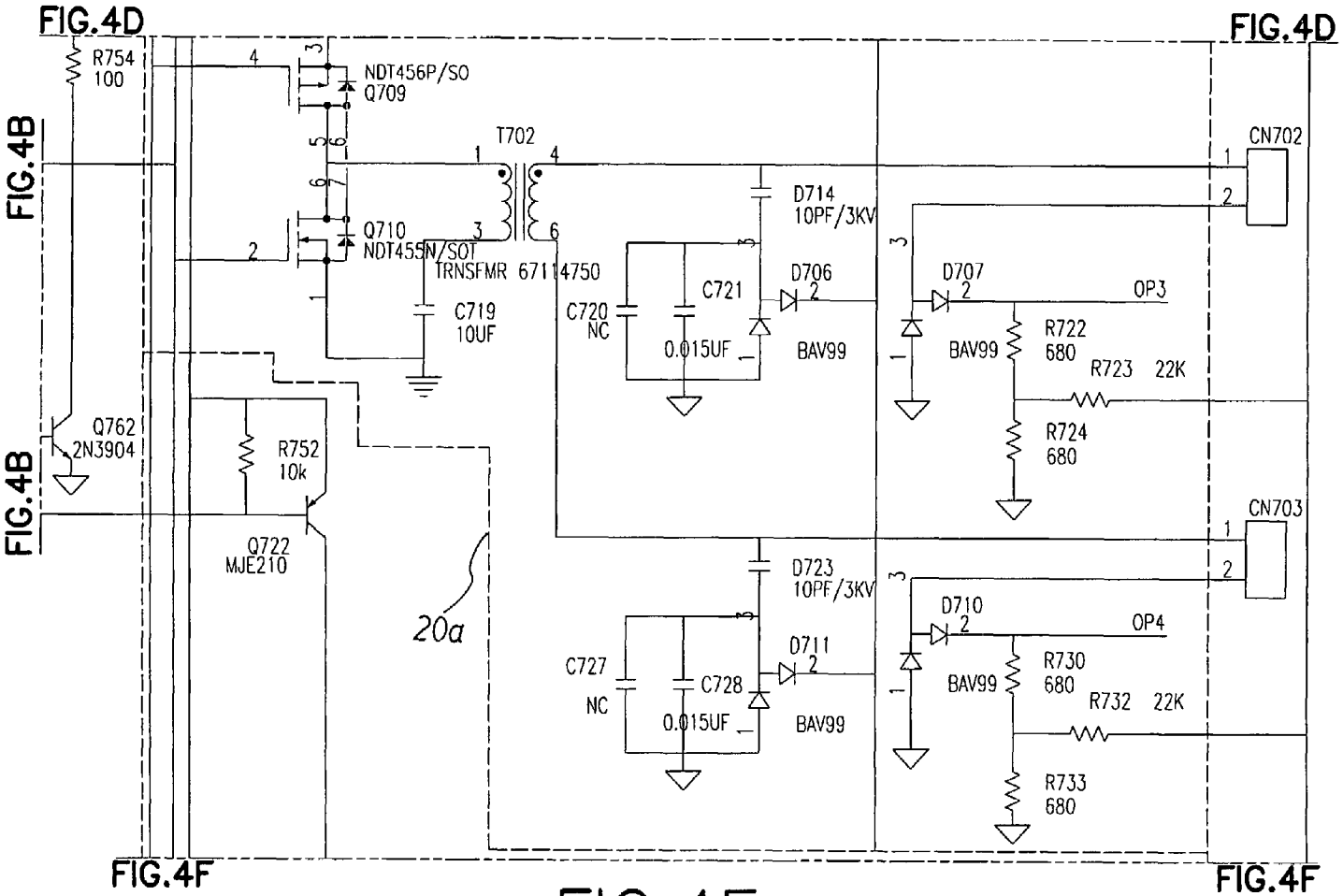
Figure 4F:
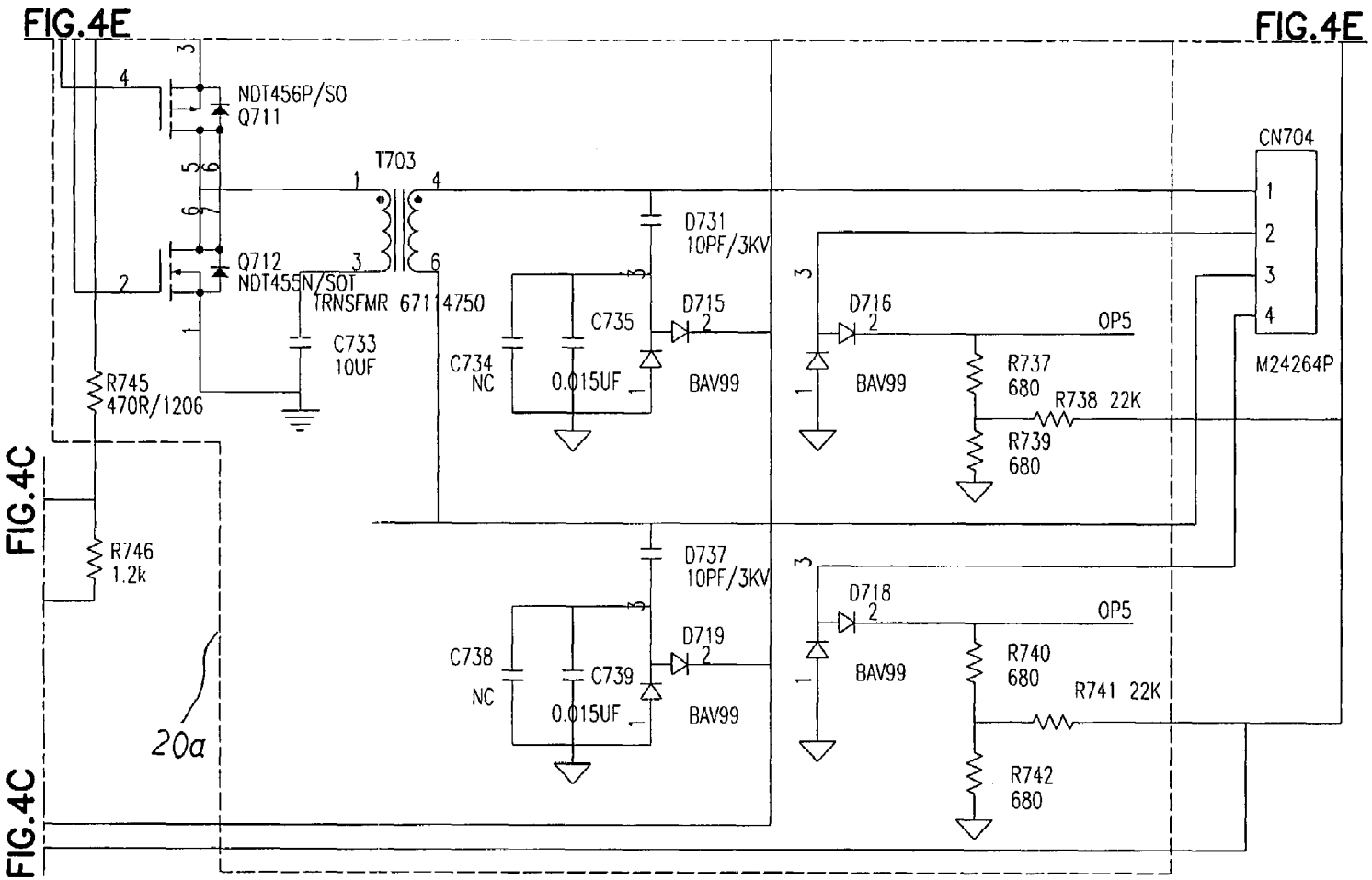

With reference to FIG. 3, a third embodiment of a backlight module control circuit of a multi-lamp display device of the present invention is shown. The third embodiment is similar to the second preferred embodiment. A main difference is that the driving circuit 20 can be coupled to a plurality of lamps 30. The circuit operation principle of this preferred embodiment is the same as the aforesaid example of the second preferred embodiment.

FIG. 4 is a detailed circuit diagram of FIG. 3. Assume that six lamps are driven for example. The input terminals AD0 to AD5 of the fault detection unit 40 detect whether there is any failure lamp in accordance with the signal OP1 to OP6. The output terminal of the PWM controller 50 is coupled to three transformers T702, T702 and T703. An output side of each of the transformers T702, T702 and T703 can drive two lamps (not shown). The lamps are coupled to connectors CN701, CN702, CN703 and CN704. When any lamp is out of order, the feedback electric current of an INN pin of the PWM controller 50 changes, so as to make the PWM controller 50 adjust the working period. Then the fault detection unit 40 controls its output pins AS, DS, and PS to shut down a corresponding transformer. For example, when OP1 and 0P2 signal display lamps are out of order, the PS pin is of low electric potential and a transistor Q720 is closed, so as to disconnect the working voltage of the first transformer T701. On the other hand, at an initial instance of starting the power, the output pins AS, DS and PS all keep at high electric potential for a period of time. During this period of time, all transformers ensure to continue outputting the electric current to drive the lamps, so as to determine whether the lamps can operate normally.

To conclude, the aforesaid examples of the preferred embodiment of the present invention of the backlight module control circuit provide the following features in comparison with the conventional control circuit:

First of all, the backlight module control circuit of the present invention can shut down the failure lamp independently: with the fault detection unit to detect the failure lamp, the control unit can shut down the driving circuit of the failure lamp independently and also continue to keep the operation of the other normal lamps.

Secondly, the backlight module control circuit of the present invention can maintain display quality of images: the control unit can enhance the driving electric circuit of the other normal lamps despite one of the lamp is out of order. Hence the whole brightness of the display device still can keep normal without decreasing the display quality of the images.

Thirdly, the backlight module control circuit of the present invention can avoid high-voltage damage: since the driving circuits use high voltage to light up the lamps, the high voltage of the driving circuits can avoid damaging the display device by shutting down the high voltage of the driving circuit of the failure lamp.

Therefore, the backlight module control circuit of the present invention includes novelty and obviously improves the conventional control circuit.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A backlight module control circuit of a multi-lamp display device comprising:

a control unit having multiple signal output terminals;

multiple driving circuits connected between the signal output terminals of the control unit and multiple lamps; and a fault detection unit having multiple signal detection input terminals respectively coupled to the lamp driving circuits and the lamps, and having a control signal output terminal coupled to the control unit;

wherein the fault detection unit detects whether any one of the lamps is out of order and then outputs a signal to the control unit, so as to make the control unit shut down the driving circuit of the failure lamp and continue to maintain an operation of other normal lamps.

2. The backlight module control circuit as claimed in claim 1, wherein the fault detection unit comprises an alarm signal output terminal.

3. The backlight module control circuit as claimed in claim 1, wherein the control unit enhances an operation current that flows through normal lamps after shutting down the driving circuit of the failure lamp.

4. The backlight module control circuit as claimed in claim 2, wherein the control unit enhances an operation current that flows through normal lamps after shutting down the driving circuit of the failure lamp.

5. The backlight module control circuit as claimed in claim 1, wherein each lamps is coupled to ground through a resistor.

6. The backlight module control circuit as claimed in claim 1, wherein the control unit is a microprocessor.

7. The backlight module control circuit as claimed in claim 1, wherein each of the lamp driving circuits comprises a PWM controller.

8. The backlight module control circuit as claimed in claim 1, wherein the control unit is a control circuit made up by a plurality of electronic components.

9. A backlight module control circuit of a multi-lamp display device comprising:

a PWM controller having a signal output terminal;

multiple lamp driving circuits connected between the signal output terminal of the PWM controller and at least one lamp; and a fault detection unit comprising signal detection input terminals and signal output terminals, wherein the signal detection input terminals are respectively coupled to the lamps, wherein the signal output terminals are respective coupled to the lamp driving circuits and the PWM controller;

wherein the fault detection unit detects whether any one of the lamps is out of order and shut down the driving circuit of the failure lamp, and also output a signal to the PWM controller to continue to maintain an operation of other normal lamps.

10. The backlight module control circuit as claimed in claim 9, wherein the fault detection unit comprises an alarm signal output terminal.

11. The backlight module control circuit as claimed in claim 9, wherein the PWM controller enhances a working period of an output signal after shutting down the driving circuit of the failure lamp, so as to enhance an operation current that flows through normal lamps.

12. The backlight module control circuit as claimed in claim 10, wherein the PWM controller enhances a working period of an output signal after shutting down the driving circuit of the failure lamp, so as to enhance an operation current that flows through normal lamps.

13. The backlight module control circuit as claimed in claim 11, wherein the other terminal of each of the lamps is coupled to the ground via a resistor.

14. The backlight module control circuit as claimed in claim 12, wherein each of the lamps is coupled to ground through a resistor.

* * * * *